US005829173A

United States Patent [19]

Svetlik et al.

[11] Patent Number: 5,829,173

[45] Date of Patent: Nov. 3, 1998

[54] CLIMBING SNOWSHOE ASSEMBLY HAVING REMOVABLE DECKING SECTIONS WITH BINDING-MOUNTED CRAMPON DISPOSED THEREBETWEEN

[76] Inventors: Paul J. Svetlik, 3451 Fenton St., Denver, Colo. 80212; Jiri Kalendovsky, 7482 Crannell Dr., Boulder, Colo. 80303

[21] Appl. No.: 812,982

[22] Filed: Mar. 5, 1997

[51] Int. Cl.[6] ..... A43B 5/04; A43B 5/16

[52] U.S. Cl. ..... 36/124; 36/122

[58] Field of Search ..... 36/122, 123, 124, 36/125

[56] References Cited

U.S. PATENT DOCUMENTS

| | | | |
|---|---|---|---|
| 2,769,250 | 11/1956 | Rinkinen | 36/4.5 |
| 4,085,529 | 4/1978 | Merrifield | 36/125 |
| 4,351,121 | 9/1982 | Wallace | 36/125 |
| 4,604,817 | 8/1986 | Ramboz | 36/125 |
| 4,620,375 | 11/1986 | Wallace | 36/7.6 |
| 4,720,927 | 1/1988 | Abegg | 36/122 |
| 4,720,928 | 1/1988 | Faber et al. | 36/122 |
| 5,253,437 | 10/1993 | Klebahn et al. | 36/122 |
| 5,259,128 | 11/1993 | Howell | 36/122 |
| 5,309,652 | 5/1994 | Campbell | 36/122 X |
| 5,341,582 | 8/1994 | Liautaud | 36/124 X |
| 5,440,827 | 8/1995 | Klebahn et al. | 36/122 |
| 5,459,950 | 10/1995 | Damm et al. | 36/123 X |
| 5,469,643 | 11/1995 | Forrest | 36/122 |
| 5,493,794 | 2/1996 | McKenzie et al. | 36/122 |
| 5,542,197 | 8/1996 | Vincent | 36/122 |

*Primary Examiner*—B. Dayoan

*Attorney, Agent, or Firm*—Flanagan & Flanagan; John R. Flanagan; John K. Flanagan

[57] ABSTRACT

A climbing snowshoe assembly includes a snowshoe having a peripheral frame and decking on the frame. The peripheral frame is formed by forward and rearward members having U-shaped configurations with facing pairs of opposite open ends, and rod-shaped insert connectors slidably interfitted with the facing pairs of opposite open ends of the forward and rearward frame members to assemble the forward and rearward frame members. The decking is made of solid flexible material formed into a front pocket section and a rear sleeve section spaced from one another and removably mounted over the forward and rearward frame members. The assembly also includes a binding having a boot support base disposed within and spaced inwardly from the peripheral frame, an axle mounting and extending transversely to a front portion of the boot support base and having opposite end portions extending outwardly from opposite sides of the boot support base, and a pair of couplers connected to the opposite end portions of the axle and slidably mounted over and detachably fastened to the insert connectors between the forward and rearward frame members. The assembly further includes a crampon fixedly attached to the front portion of the boot support base of the binding assembly and disposed between the front and rear sections of the decking.

16 Claims, 3 Drawing Sheets

CLIMBING SNOWSHOE ASSEMBLY HAVING REMOVABLE DECKING SECTIONS WITH BINDING-MOUNTED CRAMPON DISPOSED THEREBETWEEN

BACKGROUND OF THE INVENTION

1. Field of the Invention

The present invention generally relates to snowshoes and, more particularly, is concerned with a climbing snowshoe assembly.

2. Description of the Prior Art

Snowshoes of various designs, both with and without crampons, have been used for many years to traverse stretches of deep or hard snow for work, recreational and sports purposes. Representative examples of snowshoe designs proposed in the prior art are disclosed in U.S. Pat. No. 2,769,250 to Rinkinen, U.S. Pat. No. 4,351,121 to Wallace, U.S. Pat. No. 4,604,817 to Ramboz, U.S. Pat. No. 4,620,375 to Wallace, U.S. Pat. No. 4,720,928 to Faber et al, U.S. Pat. No. 5,253,437 to Klebahn et al, U.S. Pat. No. 5,259,128 to Howell, U.S. Pat. No. 5,440,827 to Klebahn et al and U.S. Pat. No. 5,469,643 to Forrest.

Many of these, as well as other, prior art snowshoe designs, however, have discouraged more general use and acceptance of snowshoes because of one or more of the following drawbacks. Many snowshoes are difficult to attach to a boot, awkward to operate and difficult to maneuver, and thereby wastes the energy of the user. The bindings of many snowshoes are so loosely fitting as to provide poor directional control and virtually no lateral control on when traversing side slopes. In addition, due to inefficient design of traction devices or crampon many prior art snowshoes are likely to slip backwards or sideways on steep slopes. Conventional decking allow the accumulation snow on the top and have holes, rivets and/or lacing around the frame which causes drag that consumes energy especially in deep powder snow. Also, many snowshoes are difficult to repair and maintain, require the use of tools to make necessary adjustments, and are subject to wear because of the materials and constructions employed. Field improvised repairs are difficult if not impossible to perform on most prior art snowshoes.

Consequently, a need still exists for an improved snowshoe design that will overcome the aforementioned drawbacks in prior art designs without introducing any new drawbacks in place thereof.

SUMMARY OF THE INVENTION

The present invention provides a climbing snowshoe assembly designed to satisfy the aforementioned need. The climbing snowshoe assembly of the present invention incorporates a peripheral frame, decking and binding axle having a makeup and arrangement which permits easy assembly and disassembly of the snowshoe to replace worn-out parts and make adjustments without the use of tools. Further, the decking prevents snow accumulation on the top of the snowshoe. Instead, snow easily slides off the decking with each forward step.

Accordingly, the present invention is directed to a climbing snowshoe assembly which includes a snowshoe having a peripheral frame and decking on the frame. The peripheral frame is formed by forward and rearward members having U-shaped configuration with facing pairs of opposite open ends, and rod-shaped insert connectors slidably interfitted with the facing pairs of opposite open ends of the forward and rearward frame members so as to assemble together the forward and rearward frame members.

The decking is made of solid flexible material formed into a front pocket section and a rear sleeve section spaced from one another and removably mounted over the forward and rearward frame members. The decking includes a pair of flexible straps extending between and attached to the front and rear sections of the decking and a pair of tension adjustable buckles one on each strap for adjusting the length of the strap to thereby retain the front and rear sections of the decking on the forward and rearward frame members so as to hold the frame together.

The climbing snowshoe assembly also includes a binding having a boot support base disposed within and spaced inwardly from the peripheral frame, an axle mounting and extending transversely to a front portion of the boot support base and having opposite end portions extending outwardly from opposite sides of the boot support base, and a pair of couplers connected to the opposite end portions of the axle and slidably mounted over and detachably fastened to the insert connectors between the forward and rearward frame members.

The climbing snowshoe assembly further includes a crampon fixedly attached to the front portion of the boot support base of the binding assembly and disposed between the front and rear sections of the decking.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
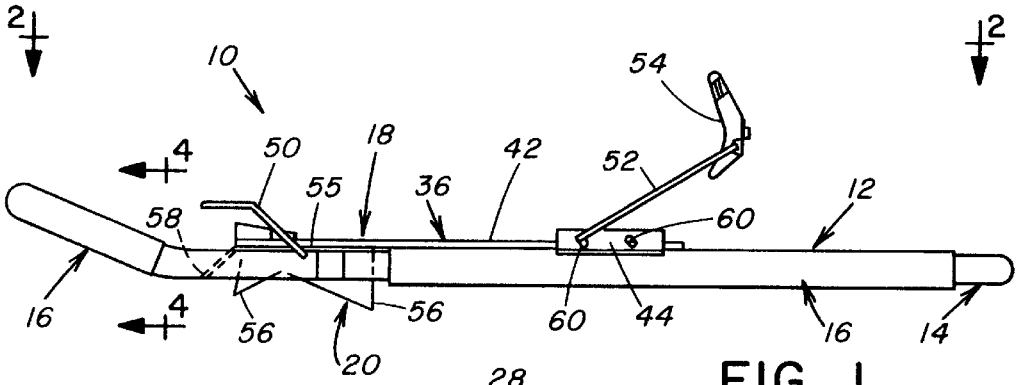
FIG. 1 is a side elevational view of a climbing snowshoe assembly of the present invention.
Figure 2:
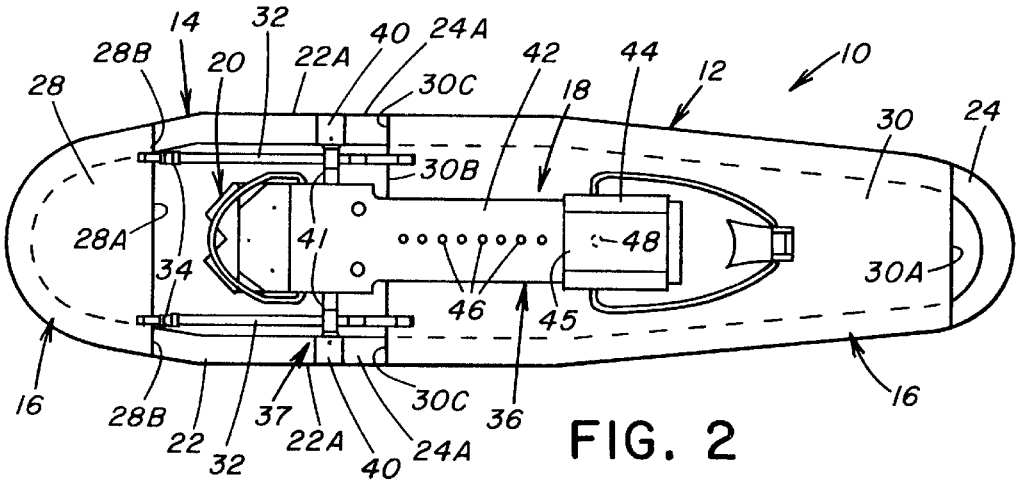
FIG. 2 is a top plan view of the climbing snowshoe assembly as seen along line 2—2 of FIG. 1.
Figure 5:
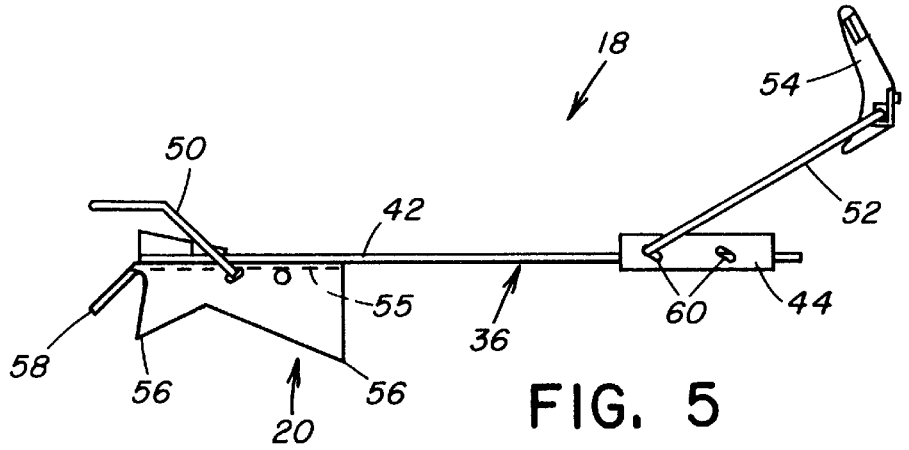
FIG. 5 is a side elevational view, on an enlarged scale, of the binding and crampton components of the climbing snowshoe assembly.
Figure 6:
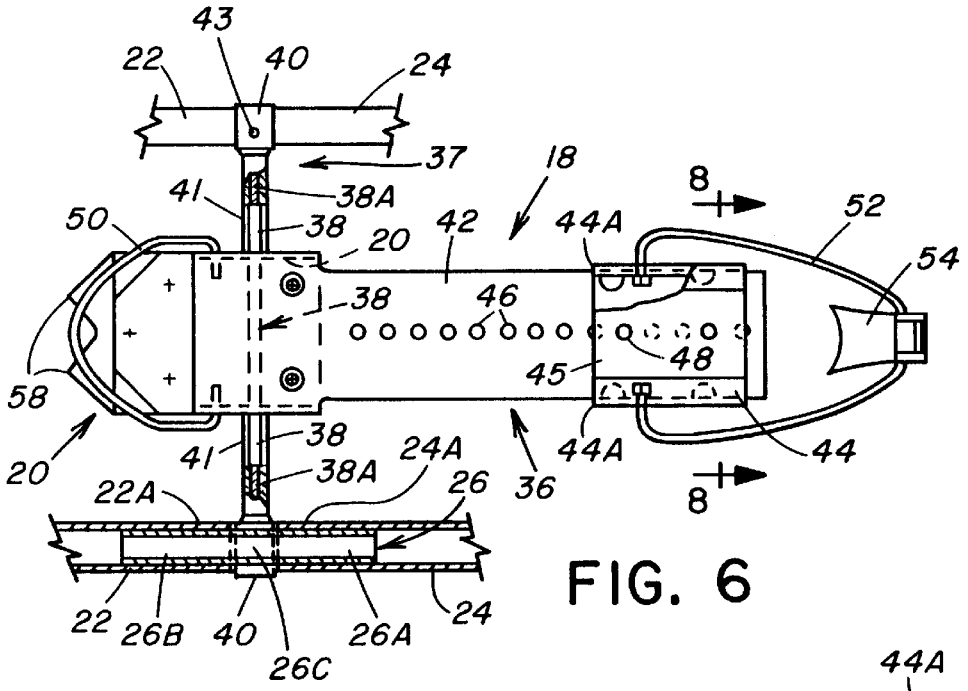
FIG. 6 is a fragmentary detailed view, on an enlarged scale, of the peripheral frame, binding and crampon components of the climbing snowshoe assembly in greater detail.
Figure 8:
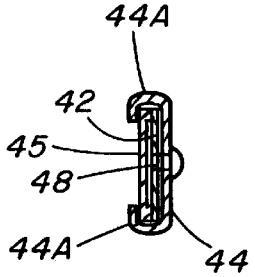
FIG. 8 is a cross-sectional view of the climbing snowshoe assembly taken along line 8—8 of FIG. 6.
Figure 7:
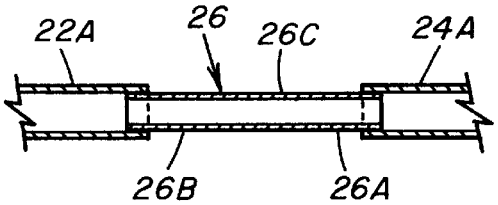
FIG. 7 is a fragmentary longitudinal sectional view, on an enlarged scale, of the peripheral frame of the climbing snowshoe assembly showing a rod-shaped insert connector of the peripheral frame slidably interfitted with forward and rearward members of the peripheral frame.

Referring to the drawings and particularly to FIGS. 1 and 2, there is illustrated a climbing snowshoe assembly, generally designated 10, of the present invention. Basically, the climbing snowshoe assembly 10 includes a snowshoe 12 having a peripheral frame 14, a decking 16 on the peripheral frame 14, and a binding 18 adapted to support an user's boot and being disposed within and spaced inwardly from the peripheral frame 14. The assembly 10 also includes a crampon 20 fixedly attached to a front end portion of the binding 18.

Referring to FIGS. 1, 2, 6 and 7, the peripheral frame 14 of the snowshoe 12 is made of a substantially rigid material, such as aluminum, and formed by forward and rearward members 22, 24. Each of the forward and rearward members 22, 24 is tubular shaped and hollow and has an U-shaped configuration. The forward member 22 has a pair of open end portions 22A for facing the open end portions 24A of the rearward member 24. The frame 14 also includes a pair of rod-shaped insert connectors 26 slidably interfitted with the facing pairs of opposite open end portions 22A, 24A of the forward and rearward members 22, 24 of the peripheral frame 14 so as to assemble the forward and rearward members 22, 24 thereof. Preferably, the one end 26A of each insert connector 26 is inserted into and fixed attached to a respective one of the end portions 24A of the rearward frame member 24 while the other end 26B of each insert connector 26 is removably and slidably inserted into a respective one of the end portions 22A of the forward frame member 22.

Figure 4:
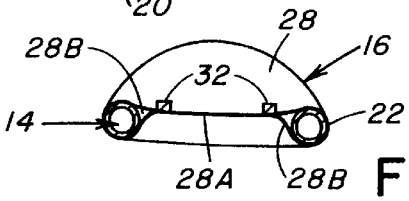
FIG. 4 is a cross-sectional view of the climbing snowshoe assembly taken along line 4—4 of FIG. 1.
Figure 3:
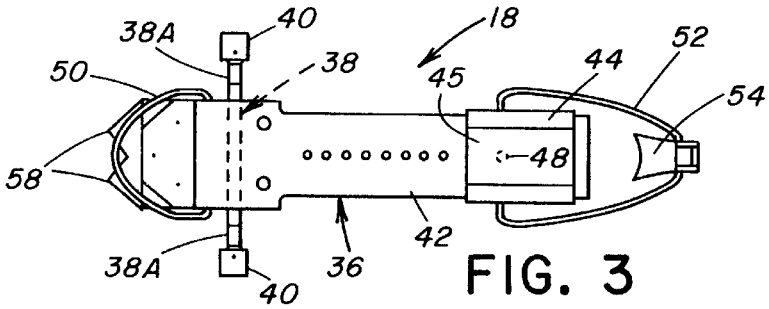
FIG. 3 is a top plan view of binding and crampon components of the climbing snowshoe assembly.

Referring to FIGS. 1, 2 and 4, the decking 16 of the snowshoe 12 is made of solid flexible material, such as a suitable inelastic and relatively slick plastic, formed into a front section 28 and a rear section 30 spaced from one another and removably mounted over the forward and rearward members 22, 24 of the peripheral frame 14. The front section 28 of the decking 16 is in the form of a pocket having an end 28A which is sewn partially closed so as to leave a pair of laterally spaced openings 28B at the end 28A which adapt the front section 28 to be slidably removably fitted over at least a front end of the forward member 22 of the frame 14. The rear section 30 of the decking 16 is in the form of a sleeve having one open end 30A and an opposite end 30B which is sewn partially closed, like the end 28A of the front section 28, to leave a pair of laterally spaced apertures 30C adapting the rear section 30 to be slidably removably fitted over a substantial proportion of the rearward member 24 of the frame 14. The decking 16 also includes at least one and preferably a pair of inelastic flexible straps 32 extending between and attached to the respective closed ends 28A, 30B of the front and rear sections 28, 30 of the decking 16, and a pair of tension adjustable buckle 34 one applied on each strap 32 for adjusting the length of the strap 32 to thereby retain the front and rear sections 28, 30 of the decking 16 on the forward and rearward frame members 22, 24 so as to hold the peripheral frame 14 together.

Referring to FIGS. 1–3, 5, 6 and 8, the binding 18 of the assembly 10 includes a boot support base 36 while the assembly 10 also includes means in the form of an axle subassembly 37 including an axle 38 for disposing the boot support base 36 within and spaced inwardly from the peripheral frame 14. The axle 38 mounts and extends transversely of a front portion of the boot support base 36 and has threaded opposite end portions 38A extending outwardly from opposite sides of the boot support base 36. Also, the axle subassembly 37 also includes a pair of couplers 40 each threadably connected to one of the threaded opposite end portions 38A of the axle 38, and a pair of spacers 41 each extending about the portions of the axle 38 between the coupler 40 and side of the boot support base 36. The couplers 40 are mounted over and detachably fastened by screws 43 to middle portions 26C of the insert connectors 26 located between the spaced apart open end portions 22A, 24A of forward and rearward frame members 22, 24. As will be explained below, the axle 38 extends transversely of and supports the boot support base 36 of the binding 18 via the crampon 20 attached to the bottom of the boot support base 36.

The boot support base 36 of the binding 18 has an elongated base plate 42, a heel plate 44 slidably mounted over a rear end of the base plate 42 and a pressure plate 45 disposed upon the heel plate 44 and extending between L-shaped flanges 44A extending along opposite sides of the heel plate 44. By means of a row of apertures 46 formed in the base plate 42 and pins 48 disposed on the heel plate 44, the heel plate 44 is releasably interfitted and secured at a selected one of different positions along a rear end portion of the base plate 42. The axle 38 extends transversely of and supports the base plate 42.

The binding 18 further includes a toe bail 50 and a heel bail 52. The toe bail 50 is pivotally attached to a front end portion of the base plate 42 for receiving and releasably fitting around a front groove in a toe portion of a user's boot. The heel bail 52 is pivotally attached to the heel plate 44 and has a clamp 54 for receiving and releasably interfitting with a rear groove in a heel portion of the user's boot.

For adjusting the binding 18 to a particular boot size, the heel wire bail 52 with the clamp 54 is rotated forward so the flattened ends of the heel wire bail 52 can exit the two oval holes 60 by pulling one leg 52A of the bail 52 out sideways. Then, the pressure plate 45 is pushed sidewise so that the heel plate 44 can be pushed down and out of engagement with the base plate 42. The heel plate 44 is then slidably adjusted to a desired position to fit the desired boot size. Next, insert two pins in the selected two of the apertures 46 of the base plate 42, slide the pressure plate 45 back into position, and put the wire bail 52 back into one of the pairs of oval holes 60. Place boot in binding 16 and check for good clamping tension. If the tension needs to be increased or decreased, then use the other one of the oval holes 60. Finally, a nylon strap (not shown) attached to the heel clamp 54 is tightened about the user's ankle.

Referring to FIGS. 1–3, 5 and 6, the crampon 20 of the assembly 10 is a channel structure (in the direction of travel) fixedly attached to the underside of the front end portion of the base plate 42 of the binding 18. The crampon 20 includes a top flat portion 55 fixedly attached to the underside of the base plate 42 of the binding 18 and a pair of side point-defining structures 56 in the form of teeth fixed along and extending downward from opposite sides of the top flat portion 55. The crampon 20 also includes a front point-defining structure 58 in the form of teeth fixed along and extending downardly and forwardly from a front edge of the top flat portion 55 of the crampon 20. The axle 38 is actually pivotally mounted to and extends through the opposite side point-defining structures 56 of the crampon 20 and along the underside of the top flat portion 55 thereof. Alternatively, the axle 38 can be pivotally mounted directly to the base plate 42.

For good traction on steep slopes, the user kicks his or her toes (with front points) into the slope. In case some snow accumulates in the crampon 20, a dragging pendulum motion of his or her leg forward on the snow surface should remove the buildup.

The binding 18 is designed to be replaceable without special tools. By releasing the buckles 34 on the two straps 32 and pulling forward on the peripheral frame 14, the forward frame member 22 will separate from the rearward frame member 24. Sliding the binding 18 (together with the crampon 20 and axle 38) forward and off the insert connectors 26 will release the tension from the fabric decking 16 so it can be easily removed from the frame 14. Squeezing the rearward member 24 of frame 14 from opposite sides with the user's legs will allow the rear section 30 of the decking 16 to be slid off one side.

In conclusion, the components of the climbing snowshoe assembly 10 as described above have the following benefits and advantages. The binding 18 is lightweight and adjustable without tools and allows easy step-in by the user for attachment of a boot in seconds with a single move of the heel bail 52 and clamp 54. The binding 18 firmly connects to any hiking or climbing boot having a gap or groove between the sole of the boot and the boot uppers for the front wire bail and the heel clamp. The decking 16 holds the two members 22, 24 of the peripheral frame 14 together by the two tension straps 32 and two adjustment buckles 34. The use of solid pieces of fabric in the form of a sleeve for snowshoe decking 16 provides a flat surface on which snow can easily slide off. The arrangement of the decking 16 allows quick and easy change of the decking. The crampon 20 is fabricated out of U-shaped aircraft aluminum alloy with front points bend down 45° for negotiating steep slopes. Robust rear teeth (which function like rudders) offer good lateral control on side slopes without being in the way while walking. The "U" shape of the crampon 20 is oriented and designed for no resistance in the forward direction allowing downhill controlled slide while holding the direction and permits easy cleaning of the snowpack, when it occurs, by dragging snowshoes back and forth in the snow. The pivotal axle 38 is preferably made of high quality steel that transfers forces to the snowshoe peripheral frame 14 over the connecting links or couplers 40 machined to fit to the outside diameter of the inserts 26 which connects with the frame tubing. These interconnections improve frame rigidity and allow complete directional control of the snowshoes—a very important feature on mountain slopes at all times. No heel travel is allowed off the center of snowshoe. The pivotal axle also allows the snowshoe 12 to swing more than 90° and yet 15 provide the user with reliable control of the snowshoe. Also, the binding 18 with the crampon 20 can be rotated about 90° to permit easy cleaning when wet snow buildup occurs.

Figure 9A:
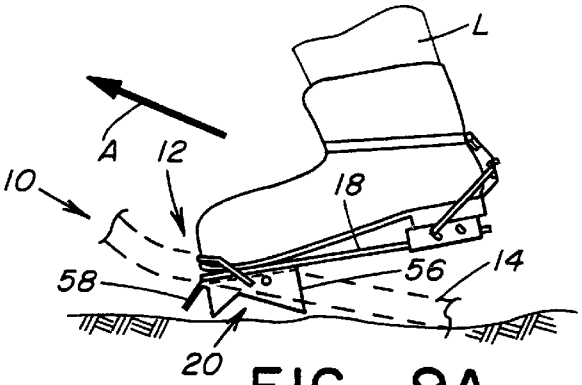
FIGS. 9A to 9E are diagrammatic views of the climbing snowshoe assembly of the present invention showing multiple functions performed by the crampon at various positions relative to the snowshoe frame.
Figure 9C:
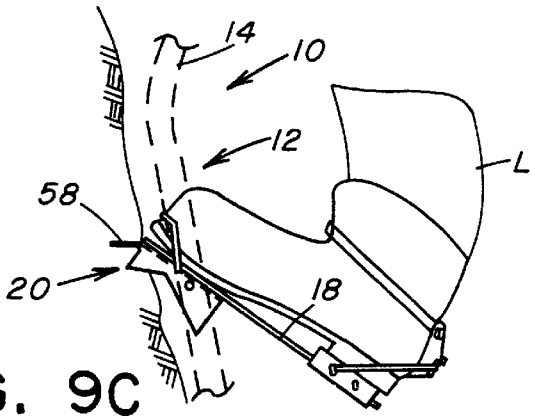
Figure 9E:
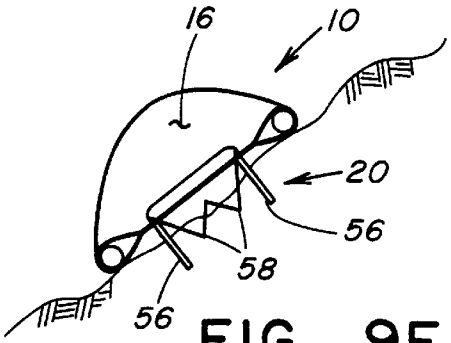
Figure 9B:
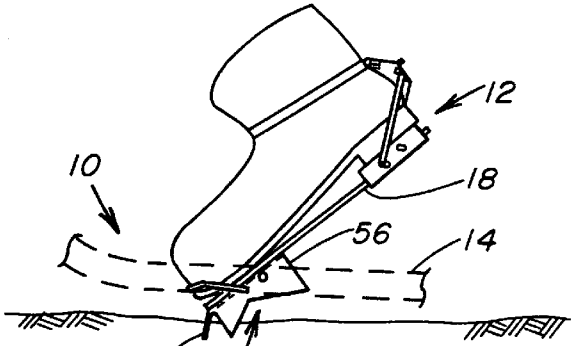
Figure 9D:
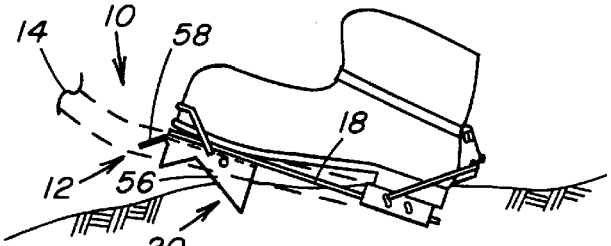

FIGS. 9A to 9E show multiple functions performed by the crampon 20 of the climbing snowshoe assembly 10 at various positions relative to the snowshoe frame 14. FIGS. 9A and 9B show a regular step taken by the user using the snowshoe assembly 10. In FIG. 9A, the user is lifting the one leg L and moving it upwardly and forwardly in the direction of arrow A. During this movement snow will slide off the decking. In FIG. 9B, the user is rolling over the ball of the foot while engaging the front point-defining structure 58 of the crampon 20 in the snow for traction. FIG. 9C shows the user climbing a steep snow slope by engaging the front point-defining structure 58 in the snow. The extra wide front points of the crampon 20 penetrate easily and provide a good supporting ledge. FIG. 9D shows the user putting his or her body weight on the heels. The front point-defining structure 58 disengages the snow and the snowshoe assembly 10 will slide downhill. The opposite side point-defining structures 56 of the crampon 20 are holding the direction of the slide. This feature could be utilized even on level snow surface. Sliding can double the speed of snowshoers thanks to the open box design of the crampon. FIG. 9E shows in cross-section the user traversing with the side point-defining structures 56 penetrating into the snow. On softer snow slopes the whole frame cuts a horizontal ledge thanks to the rigid binding-to-frame connection.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. A climbing snowshoe assembly, comprising:

(a) a snowshoe including (i) a peripheral frame having forward and rearward members, and (ii) decking on said frame, said decking being made of flexible material formed into front and rear sections separate and spaced from one another, said front and rear sections being removably mounted over said forward and rearward members of said peripheral frame, said front section of said decking being a pocket having a pair of laterally spaced openings at one end adapting said front section of decking to removably fit over at least a front end of said forward member of said peripheral frame;

(b) a binding adapted to mount a user's boot and being disposed within and spaced inwardly from said peripheral frame; and (c) means for pivotally mounting said binding to said peripheral frame at a location between said forward and rearward members thereof.

2. The assembly of claim 1 wherein said decking is made of a solid imperforate material.

3. A climbing snowshoe assembly, comprising:

(a) a snowshoe including (i) a peripheral frame having forward and rearward members, and (ii) decking on said frame, said decking being made of flexible material formed into front and rear sections separate and spaced from one another, said front and rear sections being removably mounted over said forward and rearward members of said peripheral frame, said rear section of said decking being a sleeve having one open end and a pair of laterally spaced apertures at an opposite end adapting said rear section to removably fit over a substantial proportion of said rearward member of said peripheral frames;

(b) a binding adapted to mount a user's boot and being disposed within and spaced inwardly from said peripheral frame; and (c) means for pivotally mounting said binding to said peripheral frame at a location between said forward and rearward members thereof.

4. A climbing snowshoe assembly, comprising:

(a) a snowshoe including (i) a peripheral frame having forward and rearward members, and (ii) decking on said frame, said decking being made of flexible material formed into front and rear sections separate and spaced from one another, said front and rear sections being removably mounted over said forward and rearward members of said peripheral frame, said decking including at least one flexible strap extending between and attached to said front and rear sections of said decking and a tension adjusting means on said strap for adjusting said strap to thereby retain said front and rear sections of said decking on said forward and rearward frame members so as to hold said peripheral frame together;

(b) a binding adapted to mount a user's boot and being disposed within and spaced inwardly from said peripheral frame; and (c) means for pivotally mounting said binding to said peripheral frame at a location between said forward and rearward members thereof.

5. The assembly of claim 4 wherein said decking further includes:

another flexible strap spaced from said one flexible strap and extending between and attached to the front and rear sections of the decking; and another tension adjusting means, each of said tension adjusting means being a tension adjustable buckle on each of said straps for adjusting said straps to thereby retain said front and rear sections of said decking on said forward and rearward frame members so as to hold said peripheral frame together.

6. A climbing snowshoe assembly, comprising:

(a) a snowshoe including (i) a peripheral frame having forward and rearward members, and (ii) decking on said frame, said decking being made of flexible material formed into front and rear sections separate and spaced from one another, said front and rear sections being removably mounted over said forward and rearward members of said peripheral frame;

(b) a binding including a boot support base adapted to mount a user's boot and being disposed within and spaced inwardly from said peripheral frame;

(c) means for pivotally mounting said binding to said peripheral frame at a location between said forward and rearward members thereof; and (d) a crampon having a top portion fixedly attached to an underside of a front portion of said base plate of said binding and disposed between said front and rear sections of said decking, said crampon including (i) a pair of side point-defining' structures fixed along and extending downward from opposite sides of said top portion, and (ii) a front point defining structure fixed along and extending downardly and forwardly from a front edge of said top portion;

(e) said mounting means including an elongated axle pivotally mounted to and extending through said opposite side point-defining structures of said crampon and along an underside of said top portion of said crampon, said axle being interconnected at opposite ends to said peripheral frame.

7. A climbing snowshoe assembly, comprising:

(a) a snowshoe including (i) a peripheral frame having forward and rearward members, each of said forward and rearward members of said peripheral frame having an U-shaped configuration with facing pairs of opposite open end portions, said peripheral frame further having a pair of rod-shaped insert connectors removably slidably interfitted within the facing pairs of opposite open end portions of said forward and rearward members of said peripheral frame so as to assemble together said forward and rearward members of said peripheral frame, and (ii) decking on said peripheral frame;

(b) a binding including (i) a boot support base adapted to mount a user's boot and being disposed within and spaced inwardly from said peripheral frame, the boot support base having an elongated base plate, a heel plate slidably mounted over a rear end of said base plate and means for releasably securing said heel plate at a selected position along a rear end portion of said base plate, (ii) a toe bail pivotally attached to a front end portion of said base plate for receiving and releasably fitting around a front groove in a toe portion of a user's boot, and (iii) a heel bail pivotally attached to said heel plate and having a clamp for receiving and releasably interfitting with a rear groove in a heel portion of the user's boot; and (c) an axle subassembly including (i) an axle mounting, and extending transversely to, a front portion of said boot support base and having opposite end portions extending outwardly from opposite sides of said boot support base, and (ii) a pair of couplers connected to said opposite end portions of said axle and slidably mounted over and detachably fastened to said insert connectors between said forward and rearward members of said peripheral frame.

8. The assembly of claim 7 wherein each of said insert connectors has a pair of opposite end portions received within said respective pairs of opposite open end portions of said forward and rearward members of peripheral frame, one of said end portions of each of said insert connectors being fixed to a respective one of said end portions of said forward and rearward members of said peripheral frame.

9. The assembly of claim 8 wherein each of said couplers is removably and slidably mounted over a middle portion of one of said insert connectors and releasably fastened thereto.

10. A climbing snowshoe assembly, comprising:

(a) a snowshoe including (i) a peripheral frame having forward and rearward members, each of said forward and rearward members of said peripheral frame having an U-shaped configuration with facing pairs of opposite open end portions, said peripheral frame further having a pair of rod-shaped insert connectors removably slidably interfitted within the facing pairs of opposite open end portions of said forward and rearward members of said peripheral frame so as to assemble together said forward and rearward members of said peripheral frame, and (ii) decking on said peripheral frame;

(b) a binding including a boot support base adapted to mount a user's boot and being disposed within and spaced inwardly from said peripheral frame, said boot support base including (i) an elongated base plate, (ii) a heel plate slidably mounted over a rear end of said base plate, and (iii) means for releasably securing said heel plate at a selected position along a rear end portion of said base plate;

(c) an axle subassembly including (i) an axle mounting, and extending transversely to, a front portion of said boot support base and having opposite end portions extending outwardly from opposite sides of said boot support base, and (ii) a pair of couplers connected to said opposite end portions of said axle and slidably mounted over and detachably fastened to said insert connectors between said forward and rearward members of said peripheral frame; and (d) a crampon fixedly attached to a front end portion of said base plate of said binding, said crampon including (i) a pair of side point defining structures fixed along and extending downward from opposite sides of said front end portion of said base plate, and (ii) a front point defining structure fixed along and extending downardly and forwardly from a front edge of said front end portion of said base plate.

11. A climbing snowshoe assembly, comprising:

(a) a snowshoe including (i) a peripheral frame made of substantially rigid material and having forward and rearward members each being hollow and having an U-shaped configuration with a pair of opposite open end portions, (ii) a pair of rod-shaped insert connectors removably slidably interfitted with said respective opposite open end portions of said forward and rearward members of said peripheral frame so as to assemble said forward and rearward members of said frame together, and (iii) decking on said frame made of a solid imperforate material and having front and rear sections separate and spaced from one another and mounted over said forward and rearward members of said peripheral frame, said front section of said decking being a pocket having a pair of laterally spaced openings at one end adapting said front section of decking to removably fit over at least a front end of said forward member of said peripheral frame;

(b) a binding including a boot support base adapted to mount a user's boot and being disposed within and spaced inwardly from said peripheral frame; and (c) an axle subassembly including (i) an axle pivotally mounting, and extending transversely to, a front portion of said boot support base and having opposite end portions extending outwardly from opposite sides of said boot support base, and (ii) a pair of couplers connected to said opposite end portions of said axle and slidably mounted over and detachably fastened to said insert connectors between said forward and rearward members of said frame.

12. The assembly of claim 11 wherein each of said insert connectors includes a pair of opposite end portions received within said respective pairs of opposite open end portions of said forward and rearward members of peripheral frame, one of said end portions of each insert connector being fixed to a respective one of said end portions of said forward and rearward members of said peripheral frame, each of said couplers being removably and slidably mounted over a middle portion of one of said insert connectors and releasably fastened thereto.

13. The assembly of claim 11 wherein said boot support base includes:

an elongated base plate;

a heel plate slidably mounted over a rear end of said base plate; and means for releasably securing said heel plate at a selected position along a rear end portion of said base plate.

14. The assembly of claim 13 further comprising:

a crampon fixedly attached to a front portion of said base plate of said binding, said crampon including (i) a pair of side point defining structures fixed along and extending downward from opposite sides of said front portion of said base plate, and (ii) a front point defining structure fixed along and extending downardly and forwardly from a front edge of said front portion of said base plate.

15. A climbing snowshoe assembly, comprising:

(a) a snowshoe including (i) a peripheral frame made of substantially rigid material and having forward and rearward members each being hollow and having an U-shaped configuration with a pair of opposite open end portions, (ii) a pair of rod-shaped insert connectors removably slidably interfitted with said respective opposite open end portions of said forward and rearward members of said peripheral frame so as to assemble said forward and rearward members of said frame together, and (iii) decking on said frame made of a solid imperforate material and having front and rear sections separate and spaced from one another and mounted over said forward and rearward members of said peripheral frame, said rear section of the decking being a sleeve having one open end and a pair of laterally spaced apertures at an opposite end adapting said rear section to removably fit over a substantial proportion of said rearward member of said peripheral frames;

(b) a binding including a boot support base adapted to mount a user's boot and being disposed within and spaced inwardly from said peripheral frame; and (c) an axle subassembly including (i) an axle pivotally mounting, and extending transversely to, a front portion of said boot support base and having opposite end portions extending outwardly from opposite sides of said boot support base, and (ii) a pair of couplers connected to said opposite end portions of said axle and slidably mounted over and detachably fastened to said insert connectors between said forward and rearward members of said frame.

16. A climbing snowshoe assembly, comprising:

(a) a snowshoe including (i) a peripheral frame made of substantially rigid material and having forward and rearward members each being hollow and having an U-shaped configuration with a pair of opposite open end portions, (ii) a pair of rod-shaped insert connectors removably slidably interfitted with said respective opposite open end portions of said forward and rearward members of said peripheral frame so as to assemble said forward and rearward members of said frame together, and (iii) decking on said frame made of a solid imperforate material and having front and rear sections separate and spaced from one another and mounted over said forward and rearward members of said peripheral frame, said decking including a pair of flexible straps extending between and attached to the front and rear sections of the decking and a pair of tension adjustable buckles one on each strap for adjusting said strap to thereby retain said front and rear sections of said decking on said forward and rearward frame members so as to hold said peripheral frame together;

(b) a binding including a boot support base adapted to mount a user's boot and being disposed within and spaced inwardly from said peripheral frame; and (c) an axle subassembly including (i) an axle pivotally mounting, and extending transversely to, a front portion of said boot support base and having opposite end portions extending outwardly from opposite sides of said boot support base, and (ii) a pair of couplers connected to said opposite end portions of said axle and slidably mounted over and detachably fastened to said insert connectors between said forward and rearward members of said frame.

* * * * *